United States Patent [19]

Binger et al.

[11] 4,200,427

[45] Apr. 29, 1980

[54] REVERSIBLE GEAR PUMP WITH INVARIANT FLOW DIRECTION

[75] Inventors: Bernhard Binger, Ravensburg; Anton Engstler, Friedrichshafen, both of Fed. Rep. of Germany

[73] Assignee: Zahnradfabrik Friedrichshafen AG, Friedrichshafen, Fed. Rep. of Germany

[21] Appl. No.: 943,617

[22] Filed: Sep. 19, 1978

[30] Foreign Application Priority Data

Sep. 23, 1977 [DE] Fed. Rep. of Germany ..... 2742821

[51] Int. Cl.[2] ..... F04C 1/06; F04C 15/02

[52] U.S. Cl. ..... 418/32; 418/166

[58] Field of Search ..... 418/166, 171, 32; 417/315

[56] References Cited

U.S. PATENT DOCUMENTS

| | | | |
|---|---|---|---|
| 3,039,677 | 6/1962 | Nissley | 418/32 |
| 3,118,387 | 1/1964 | Aldrich | 418/32 |
| 3,303,783 | 2/1967 | Neubauer | 418/32 |

FOREIGN PATENT DOCUMENTS

| | | | |
|---|---|---|---|
| 2055883 | 5/1972 | Fed. Rep. of Germany | 418/32 |
| 388767 | 3/1933 | United Kingdom | 418/32 |

*Primary Examiner*—John J. Vrablik
*Attorney, Agent, or Firm*—Karl F. Ross

[57] ABSTRACT

A gear pump for unidirectionally transporting a fluid such as oil has a stationary housing with an inlet port and an outlet port on opposite sides of the axis of a cylindrical chamber in which a ring with an eccentric inner periphery is rotatable through an arc of 180° between two limiting positions. Freely rotatable within the inner ring periphery is an annular outer rotor with internal gear teeth entrainable by a driven inner rotor with external gear teeth, the latter numbering one less than the internal gear teeth of the outer rotor. A face of the ring has one or more shallow depressions open toward the outer rotor, each depression being spanned by a leaf spring which is anchored to the ring and defines with the outer periphery of that rotor a wedge-shaped gap diverging symmetrically toward its ends to form alternate lodgments for a rotary coupling member such as a ball or a roller. With the ring in one of its limiting positions and the rotors being driven in a direction in which the pumping spaces formed between the coacting rotor teeth move the fluid from the inlet port to the outlet port, the coupling member lies free or under light spring pressure in the downstream lodgment as seen in the direction of rotation. When the rotor drive is reversed, leakage fluid present at the contact surface between the outer rotor and the ring builds up sufficient pressure to drive the coupling member toward the narrow waist of its gap to entrain the ring into its other limiting position in which it is arrested as the coupling member moves past that waist into its opposite lodgment.

8 Claims, 4 Drawing Figures

REVERSIBLE GEAR PUMP WITH INVARIANT FLOW DIRECTION

FIELD OF THE INVENTION

Our present invention relates to a gear pump of the positive-displacement type which can be bidirectionally driven to transport a fluid (e.g. oil) in an invariable direction between an inlet port and an outlet port of its housing.

BACKGROUND OF THE INVENTION

Gear pumps of this type are known, for example, from U.S. Pat. Nos. 2,140,966 and 3,118,387 as well as British Pat. No. 388,767. They generally comprise a ring rotatable about the axis of a substantially cylindrical housing chamber between two limiting positions about 180° apart. The ring has an eccentric inner periphery defining a circular cutout within which an annular outer rotor with internal gear teeth is freely rotatable about another axis. An inner rotor has external gear teeth numbering one less than the internal gear teeth of the outer rotor and meshing therewith for entraining the latter when the inner rotor is driven by an outside prime mover. With the inner rotor centered on the chamber axis, the inter-teeth spaces formed by the two rotors vary in volume, increasing and decreasing in respective zones which lie on opposite sides of a plane of symmetry defined by the two axes. With a given direction of rotation, the ring surrounding the rotors occupies a limiting position in which the inlet and outlet ports respectively register with the zones of increasing and decreasing inter-teeth spaces so that the working fluid is pumped from the inlet port to the outlet port. When the direction of rotation is reversed, the ring must rotate into its alternate limiting position to maintain the same relationship between the ports and the zones of varying tooth spacing so that the working fluid continues to flow in the proper direction.

Various means are known for performing the switchover between the two limiting ring positions. Essentially, the ring is frictionally entrained by the outer rotor until it comes to rest against a suitable stop after half a revolution. In order to reduce the frictional resistance exerted upon the outer rotor by the arrested ring, the aforementioned U.S. Pat. No. 3,118,387 proposes to split that ring into two interconnected halves which are wedged apart by a lever coming to rest against a stop in either limiting position. A brochure published in 1969 by the assignee of that patent, entitled "Gerotor Standards", describes a spring-loaded slider inserted between the outer rotor and the eccentric ring which reduces—but does not eliminate—the frictional contact between the relatively rotating elements. German printed specification No. 2,055,883 describes a slider of this type which during steady-state operation is removed by fluid pressure from contact with the outer rotor against which it is held by a spring force during the switchover.

OBJECT OF THE INVENTION

The object of our present invention is to provide improved switchover means for a gear pump of the type referred to, designed to minimize the frictional resistance normally encountered by the rotors while being of simple structure and easy to install.

SUMMARY OF THE INVENTION

In accordance with our present improvement, the eccentric ring is provided with one or more general radial passages open toward the outer rotor, each passage being spanned by a leaf spring lying near the circumference of the outer rotor and defining therewith a wedge-shaped gap which diverges symmetrically from a narrow waist to form enlarged lodgments at its ends. A rotary coupling member, such as a ball or a roller, is receivable in either of these lodgments but is unable to traverse the waist of the gap without deforming the leaf spring. During normal operation, the coupling member occupies the downstream lodgment as seen in the direction of rotation. Upon reversal of this rotation, the coupling member is displaced from its lodgment toward the waist of the gap by pressure of leakage fluid present between the outer rotor and the eccentric ring whereby the latter is frictionally entrained into its other limiting position; thereafter, the coupling member is further entrained, with a rolling motion, by the outer rotor past the waist into the other lodgment.

Advantageously, the passages formed in the eccentric ring are represented by shallow depressions in one of the ring faces. The opposite face may have an arcuate channel extending over approximately half the circumference of the ring and receiving a projection on the housing for defining therewith the two limiting ring positions.

BRIEF DESCRIPTION OF THE DRAWING

The above and other features of our invention will now be described in detail with reference to the accompanying drawing in which.

SPECIFIC DESCRIPTION

Figure 1:
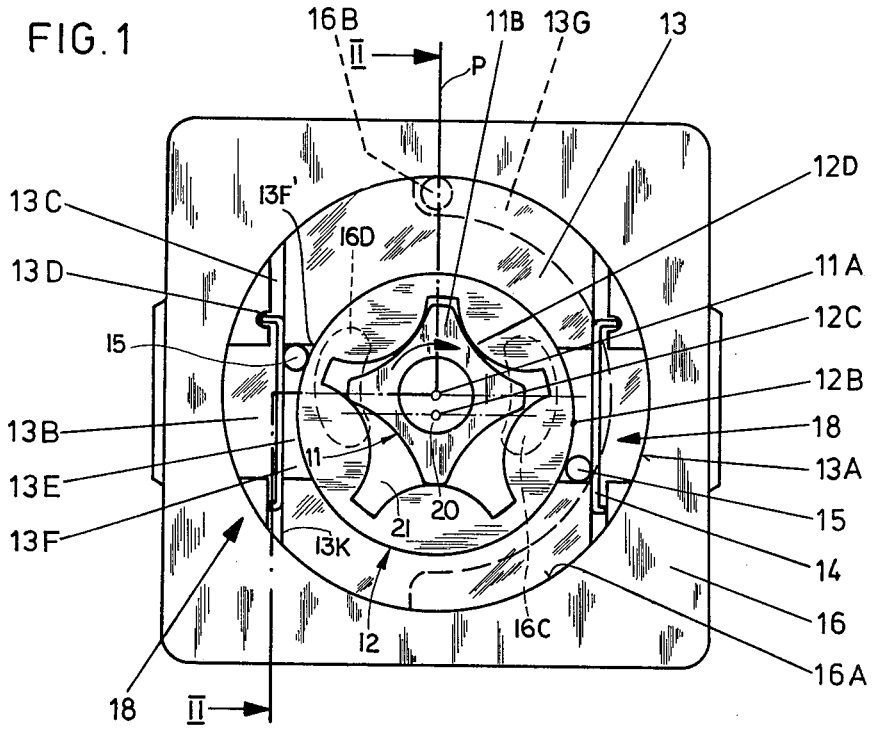
FIG. 1 is a face view of the housing and other parts of a gear pump provided with switchover means according to our invention, as seen on the line I—I of FIG. 2.
Figure 2:
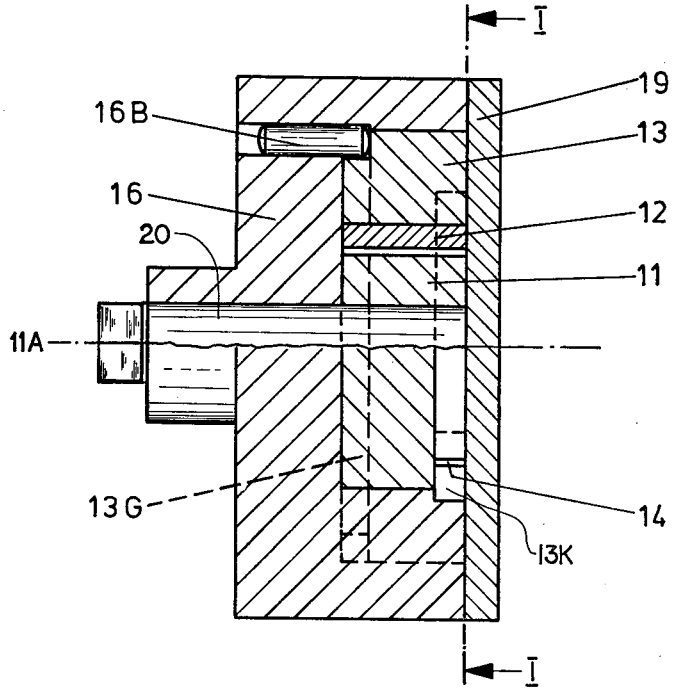
FIG. 2 is a cross-sectional view taken on the line II—II of FIG. 1.

In FIGS. 1 and 2 we have shown a pump housing 16 forming a cylindrical chamber 16A centered on an axis 11A in line with a shaft 20 which can be reversibly driven by a nonillustrated prime mover. Shaft 20 is rigid with an inner rotor 11 having a plurality of external gear teeth 11B (here four) meshing with internal gear teeth 12D of an annular outer rotor 12; the number of gear teeth 12D on the outer rotor, here five, exceeds by one the number of gear teeth 11B on the inner rotor.

The outer rotor 12 has a cylindrical peripheral surface 12B, centered on an axis 12C parallel to axis 11A, and is received with a loose fit in an eccentric cutout of a ring 13 whose outer periphery 13A is centered on axis 11A and is embraced by the peripheral wall of chamber 16A. The coplanar front faces of rotors 11, 12 and ring 13 loosely adjoin a cover 19 which is normally bolted or otherwise secured to the housing 16 but has been removed in the view of FIG. 1. The rear face of ring 13 is formed with an arcuate channel 13G, extending over about half its circumference, which receives a pin 16B fixedly lodged in housing 16. Pin 16B and channel 13G define two diametrically opposite limiting positions for ring 13 which normally occupies one of these positions, as shown.

Housing 16 further has an inlet port 16C and an outlet port 16D for a fluid to be pumped, such as an oil whose presence at the contact surfaces of rotors 11 and 12, ring 13, housing 16 and cover 19 has a lubricating effect reducing the frictional resistance encountered by drive shaft 20. These two ports are symmetrically disposed on opposite sides of a plane of symmetry P defined by the parallel axes 11A and 12C. In the illustrated position of ring 13, and with rotors 11 and 12 rotating clockwise as indicated by an arrow in FIG. 1, inlet port 16C registers with a zone in which the pumping spaces 21 defined by the gear teeth 11B and 12D progressively increase; conversely, outlet port 16D registers with a zone of decreasing inter-teeth spaces. When the direction of rotation is reversed, ring 13 must turn into its alternate limiting position to maintain the fluid flow from port 16C to port 16D.

For this purpose, pursuant to our present invention, ring 13 is provided with switchover means 18 at one or more locations (here two). The front face of this ring has two diametrically opposite shallow depressions 13B which are open towards the periphery 12B of rotor 12 and have extensions in the form of grooves 13C accommodating the ends of respective leaf springs 14. Each of these leaf springs has a bent-over extremity hooked into a recess 13D of the corresponding slot 13C. The inner edges 13K of the slots form shoulders keeping the spring extremities at a certain distance from rotor circumference 12B whereby each spring 14 forms with that circumference a wedge-shaped gap 13E with a narrow waist and enlarged ends 13F, 13F' serving as alternate lodgments for a rotary coupling member 15. The diameter of this coupling member is greater than the width of gap 13E at its waist, as measured in the unstressed state of the respective spring 14, whereby that spring must flex outwardly to let the member 15 pass from one lodgment to the other.

When seated in either of these lodgments, member 15 makes only light contact with rotor 12, ring 13 and spring 14 so as to exert but a negligible frictional resistance upon the rotor. The lodgments 13F' occupied by the members 15 in the position of FIG. 1, which corresponds to steady-state operation, lie at the downstream ends of the corresponding gaps 13E. It will be noted that these lodgments 13F' form a small pocket behind the associated coupling members 15.

Upon the reversal of the direction of rotation, i.e. with rotor 12 beginning to turn counterclockwise as viewed in FIG. 1, leakage oil forming a thin film between the outer rotor surface 12B and the inner periphery of ring 13 begins to accumulate in these pockets and to thrust the members 15 toward the waists of their gaps 13E with resulting outward bending of springs 14 whereby these members become wedged between the springs and the rotor 12. This causes entrainment of the ring 13 in the new direction of rotation until the stop 16B strikes the opposite end of channel 13G and arrests the ring in its alternate limiting position.

The continuing movement of rotor 12 then advances the coupling members 15 past the waists of their gaps into the opposite lodgments 13F where they remain until the next change in the direction of rotation.

Figure 3:
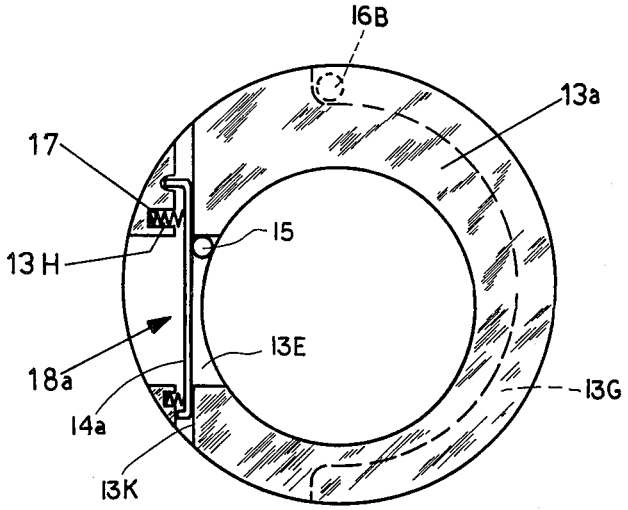
FIG. 3 is a face view of an eccentric ring provided with modified switchover means pursuant to our invention.

In FIG. 3 we have shown modified switchover means 18' on a ring **13*a* having additional recesses 13H whioh accommodate ancillary springs 17 bearing under light pressure upon respective extremities of leaf spring 14*a*; the latter is here slightly longer than the spring 14 of FIG. 1. Springs 17 confront the shoulders 13K which again maintain a limited width of gap 13E and prevent the clamping of coupling member 15 between the spring 14*a*** and the nonillustrated outer rotor during normal operation.

Figure 4:
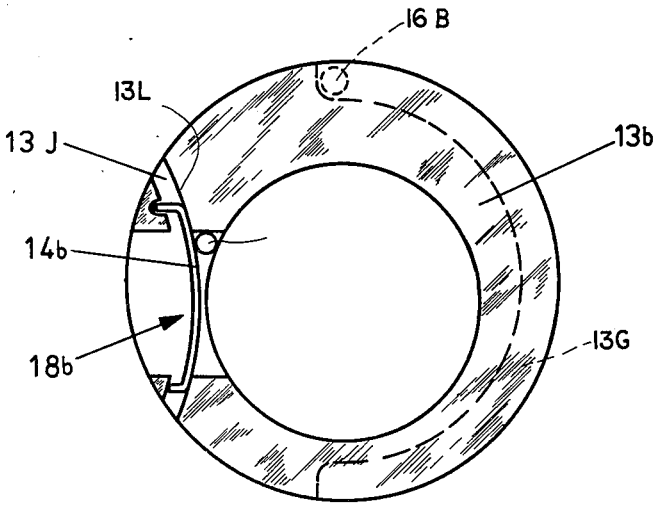
FIG. 4 is a view similar to FIG. 3, illustrating another modification.

FIG. 4 shows still another form of switchover means **18*b* with a leaf spring 14*b* which, in contrast to the flat springs 14 and 14*a* of the preceding Figures, is curved with its convex side facing the cutout of a ring 13*b*. Slots 13J, bounded by shoulders 13L, are similarly curved. This configuration results in an earlier wedging of coupling member 13 as it moves toward the waist of the gap which here is narrower than in the aforedescribed instances. Naturally, spring 14*b* could also be provided with ancillary springs such as those shown at 17 in FIG. 3. These ancillary springs, moreover, could be replaced by resilient tongues of spring 14*a* or 14*b* with omission of recesses 13H**.

Switchover means **18*a* and 18*b* of FIGS. 3 and 4 could also be duplicated at one or more peripherally spaced locations of ring 13*a* or 13*b***, if desired. Such duplication, which preserves the symmetry of the pump layout, may be desirable where gravity or other external forces have to be taken into account.

The design of passages 13B as shallow depressions in the face of the eccentric ring 13, **13*a* or 13*b*** enables their economical formation, e.g. by a cavity-sinking process.

We claim:

1. In a gear pump including a housing having a generally cylindrical chamber centered on a first axis, a ring rotatable in said chamber between two limiting positions, said ring having a circular cutout centered on a second axis offset from said first axis, an annular outer rotor centered on said second axis and held in said cutout for free rotation relative to said ring, an inner rotor centered on said first axis within said outer rotor and provided with a drive shaft for bidirectional rotation by an outside prime mover, said inner rotor being provided with a plurality of external gear teeth, said outer rotor being provided with a number of internal gear teeth exceeding by one the number of said external gear teeth, said internal and external gear teeth meshing with each other for rotary entrainment of said outer rotor by said inner rotor with formation of inter-teeth spaces of varying volume, said housing being provided with an inlet port and an outlet port on opposite sides of a plane of symmetry defined by said first and second axes, and switchover means for rotating said ring from one of said limiting positions to the other upon a reversal of rotation of said rotors by said prime mover to maintain said inlet and outlet ports in communication with said inter-teeth spaces in zones of increasing and decreasing volume thereof, respectively, whereby fluid is invariably transported from said inlet port to said outlet port, the improvement wherein said ring is provided with at least one generally radial passage open toward said outer rotor, said switchover means comprising a leaf spring spanning said passage near the outer periphery of said outer rotor and defining therewith a wedge-shaped gap diverging symmetrically from a narrow waist to form enlarged lodgments at the ends of said gap, said switchover means further comprising a rotary coupling member in said gap receivable in either of said lodgments but unable to traverse said waist without deformation of said leaf spring, said coupling member occupying the downstream lodgment as seen in the direction of rotation and being displaceable therefrom toward said waist by pressure of leakage fluid present between said ring and said outer rotor upon reversal of rotation of said rotors with resulting frictional entrainment of said ring to its other limiting position and subsequent frictional entrainment of said coupling member by said outer rotor past said waist into the opposite lodgment.

2. The improvement defined in claim 1 wherein said leaf spring has a bent-over extremity hooked into a recess of said ring.

3. The improvement defined in claim 1 or 2 wherein said leaf spring is substantially flat.

4. The improvement defined in claim 1 or 2 wherein said leaf spring is convex toward said outer rotor.

5. The improvement defined in claim 1, further comprising resilient means urging said leaf spring toward said rotor in the vicinity of said lodgments with exertion of a light contact pressure upon said coupling member.

6. The improvement defined in claim 1 or 5 wherein said passage forms shoulders engaged by the extremities of said leaf spring on the side facing said rotors for positively defining the outer boundary of said gap.

7. The improvement defined in claim 1 wherein said ring is provided with an arcuate channel extending over substantially half its circumference, further comprising a projection on said housing extending into said channel for arresting said ring in said limiting positions.

8. The improvement defined in claim 1, 2 or 7 wherein said passage is a shallow depression on a face of said ring.

* * * * *